US008966841B2

(12) United States Patent
Rissone

(10) Patent No.: US 8,966,841 B2
(45) Date of Patent: Mar. 3, 2015

(54) ADJUSTABLE DOOR THRESHOLD

(76) Inventor: Robert Rissone, Rochester, NY (US)

( * ) Notice: Subject to any disclaimer, the term of this patent is extended or adjusted under 35 U.S.C. 154(b) by 0 days.

(21) Appl. No.: 13/463,168

(22) Filed: May 3, 2012

(65) Prior Publication Data

US 2012/0210650 A1 Aug. 23, 2012

Related U.S. Application Data

(62) Division of application No. 11/641,958, filed on Dec. 20, 2006, now Pat. No. 8,186,114.

(51) Int. Cl.

| | |
|---|---|
| ***E06B 1/04*** | (2006.01) |
| ***E04C 2/38*** | (2006.01) |
| ***E06B 1/70*** | (2006.01) |
| ***E06B 7/23*** | (2006.01) |

(52) U.S. Cl.

CPC ..... *E06B 1/70* (2013.01); *E06B 7/2316* (2013.01)

USPC ..... 52/211; 52/212; 52/717.01; 49/467; 49/468

(58) Field of Classification Search

USPC ..... 52/204.1, 210, 211, 717.01, 177, 212; 49/467, 468, 469; 16/7, 8, 16

See application file for complete search history.

(56) References Cited

U.S. PATENT DOCUMENTS

| | | | | |
|---|---|---|---|---|
| 2,089,380 | A * | 8/1937 | Kammerer | 49/468 |
| 2,575,657 | A * | 11/1951 | Curley | 49/469 |
| 2,862,261 | A * | 12/1958 | Quoss | 49/468 |
| 2,980,943 | A * | 4/1961 | Calandro et al. | 16/7 |
| 3,254,361 | A * | 6/1966 | Craven et al. | 16/16 |
| 3,543,326 | A * | 12/1970 | Rohrberg et al. | 16/16 |
| 3,667,192 | A * | 6/1972 | Sewell | 52/213 |
| 3,762,100 | A * | 10/1973 | Kempel | 49/468 |
| 4,399,636 | A | 8/1983 | Blackwell | |
| 4,913,576 | A * | 4/1990 | Grant, Jr. | 403/13 |
| 5,010,690 | A * | 4/1991 | Geoffrey | 49/468 |
| 5,577,349 | A | 11/1996 | Rissone | |
| 5,657,598 | A * | 8/1997 | Wilbs et al. | 52/287.1 |
| 5,673,517 | A * | 10/1997 | Stanclift | 49/468 |
| 6,052,949 | A | 4/2000 | Procton et al. | |
| 6,289,635 | B1 * | 9/2001 | Procton et al. | 49/467 |
| 6,345,480 | B1 * | 2/2002 | Kemper et al. | 52/395 |
| 6,381,905 | B1 | 5/2002 | Rissone | |
| 6,442,901 | B1 | 9/2002 | Rissone | |
| 6,647,680 | B2 * | 11/2003 | Daly et al. | 52/287.1 |
| 7,043,792 | B2 * | 5/2006 | Kessler | 15/215 |

(Continued)

OTHER PUBLICATIONS

U.S. Appl. No. 11/641,958, filed Dec. 20, 2006, Rissone.

*Primary Examiner* — Ryan Kwiecinski
(74) *Attorney, Agent, or Firm* — Nixon & Vanderhye P.C.

(57) ABSTRACT

A door threshold may comprise a main body formed from two feet. In certain example embodiments, a male-female connection between the feet may be used to adjust the depth of the door threshold. In certain other example embodiments, a center bridge insert to be used in connection with two female feet to adjust the depth of the door threshold. In still further example embodiments, one or more center layers may be disposed between two feet, with the size of the center layer(s) determining the depth of the door threshold. Also, the door threshold may include upper and lower members for sandwiching carpet and/or carpet padding therebetween which, in certain example embodiments, may grip the carpet to reduce the ease with which it may be pulled out from between the upper and lower members. Thus, certain example embodiments may reduce and/or eliminate the need for tacks proximate to the threshold.

1 Claim, 8 Drawing Sheets

(56) References Cited

U.S. PATENT DOCUMENTS

| | | | | |
|---|---|---|---|---|
| 7,062,881 | B2 * | 6/2006 | Rissone | 49/467 |
| 7,540,067 | B2 * | 6/2009 | Colbourne et al. | 16/7 |
| 7,681,372 | B2 | 3/2010 | Rissone | |
| 8,186,114 | B2 * | 5/2012 | Rissone | 52/211 |
| 2004/0168381 | A1 * | 9/2004 | Rissone | 52/211 |
| 2006/0150565 | A1 * | 7/2006 | Schacht et al. | 52/716.1 |

* cited by examiner

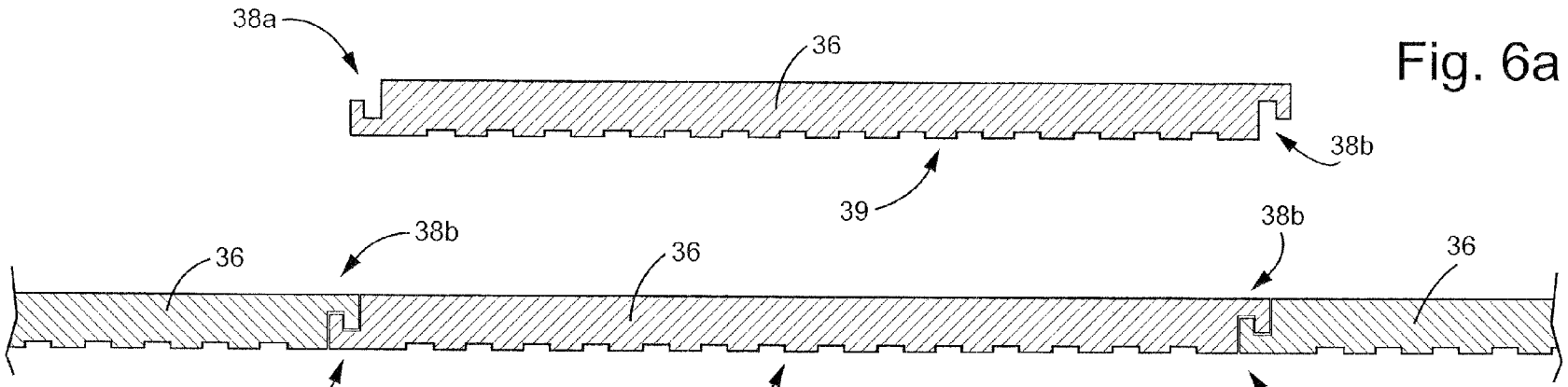
Fig. 6a
Fig. 6b
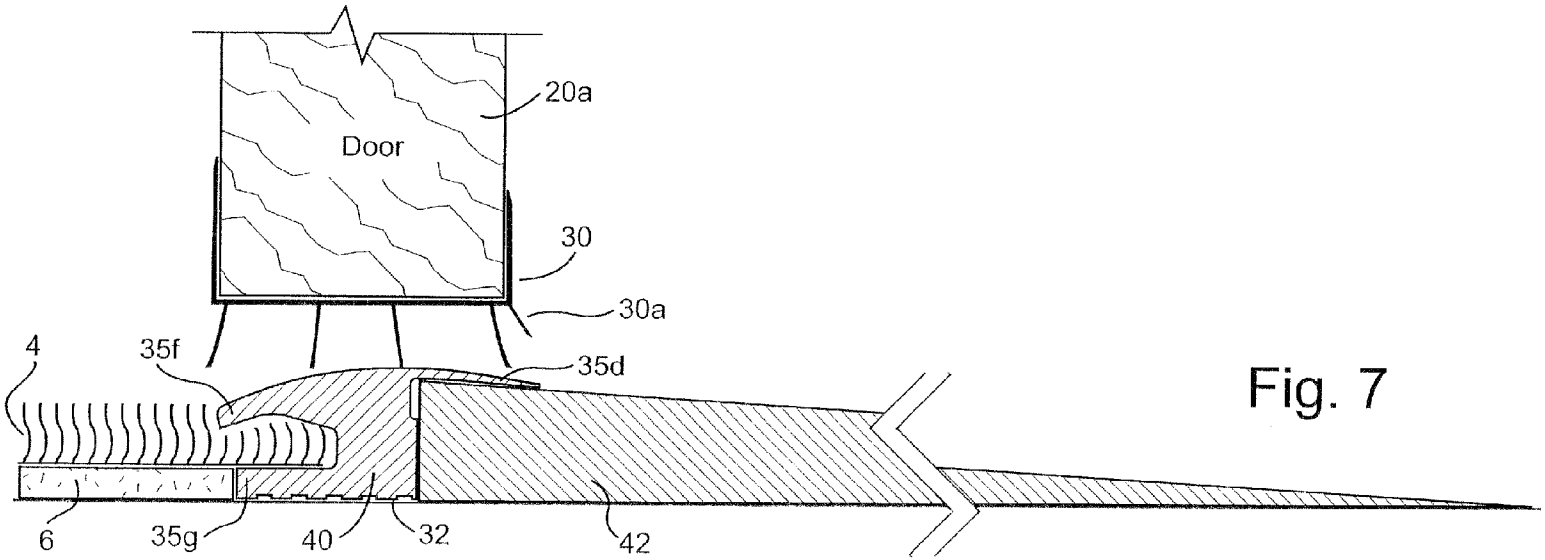
Fig. 7

ADJUSTABLE DOOR THRESHOLD

This application is a Divisional of Ser. No. 11/641,958, filed Dec. 20, 2006now U.S. Pat No. 8,186,114, the entire content of which is hereby incorporated by reference in this application.

FIELD OF THE INVENTION

Certain example embodiments of this invention relate a door threshold. More particularly, certain example embodiments of this invention relate to a door threshold that permits certain installation sequencing/issues to be controlled in varying degrees, addresses issues of security, and/or allows for improved practical uses. Door thresholds according to certain example embodiments of this invention may be used in the context of fire doors or any other suitable door application.

BACKGROUND AND SUMMARY OF EXAMPLE EMBODIMENTS OF THE INVENTION

FIG. 1 illustrates a known door threshold. In FIG. 1, threshold 1 serves as a carpet divider, is located under the door, and includes at least one overhang 3 under which carpet 4 and carpet pad 6 may be run. The FIG. 1 threshold is typically made of aluminum.

Threshold 1 of FIG. 1 requires the presence of carpet tacks 5 and supports 7 therefor proximate to the overhangs 3 in order to fasten down the carpet 4 so as to prevent the carpet from slipping out from over the overhangs 3. However, if the carpet 4 wears out, or tears, tacks 5 tend to poke through the carpet and can be a hazard because they can injure feet of a person walking near the threshold.

FIG. 2 is a perspective view of a door threshold that reduces and/or eliminates the need for carpet tacks, thus representing an improvement over certain prior art systems. Thresholds of this type are disclosed in, for example, application Ser. No. 11/344,114, the entire content of which is hereby incorporated herein by reference. Threshold 10 may be of aluminum or the like. Threshold 10, on one or both sides thereof, includes upper and lower members, 12 and 14 respectively, which sandwich an end of carpet 4 therebetween. As shown in FIG. 2, carpet pad 6 may stop short of the lower member 14 so that only the carpet 4 is sandwiched between the upper and lower members 12 and 14 in certain embodiments (although this need not be the case in all embodiments). In certain embodiments, at least parts of the upper and lower members 12 and 14 are substantially parallel (i.e., parallel plus/minus about 20 degrees) to one another.

In certain embodiments, upper and/or lower member(s) 12, 14 grip or otherwise maintain the carpet 4 that is located therebetween. Thus, the need for carpet tacks proximate to the threshold is reduced and/or eliminated because the threshold itself maintains the end of the carpet in position and reduces the ease with which it may be pulled out from between members 12, 14. Overhang 12 may be flexible in certain embodiments, so as to provide a downward-directed biasing force against the carpet 4 to help maintain the end of the carpet between members 12 and 14. The threshold further allows for a variety of different carpet and/or pad thicknesses, and can maintain a slight rise above the carpet for a door sweep to seal against and yet not rub or significantly rub on the carpet when closing.

Carpeting 4 typically is glued down or stretched and held by carpet tack strips along the walls. At the door opening, the carpet cannot be glued to a pad typically. The carpet tuck feature of threshold 10 effectively grips the carpet and reduces the ease with which it may be pulled away from the threshold. The carpet will have been stretched and held at either side of the door opening.

As shown in FIG. 2, the top surface 10*a* of the threshold 10 includes a peak or highest elevation portion 10*b*. Then, the top surface 10*a* preferably slopes downwardly from peak 10*b* on both sides thereof to lower elevation portions 10*c*. The top surfaces of lower elevation portions 10*c* typically are sloped from about 5 to 60 degrees, more preferably from about 10 to 35 degrees, relative to the a top flat portion of peak lob. Moreover, as shown in FIG. 2, the bottom member or base 14 of the threshold may be divided into two separate and distinct feet 14*a* and 14*b* that are separated from one another by gap or cavity 15. Typically, the gap or cavity 15 is located under the peak portion 10*a* of the threshold. Feet 14*a*, 14*b* are preferably attached to the floor (or other support located over the floor) via an adhesive, screws, or the like. The door frame may be made of steel, aluminum, wood, or any other suitable material.

While the thresholds described with reference to FIG. 2 are more advantageous than certain prior art thresholds, further improvements are still possible. For example, sometimes a stock threshold, also called a transition strip, is provided to allow for separating carpet colors and/or patterns. However, such stock transition strips do not account for the many variations in wall- and frame-depth. For example, current thresholds are made to a specific depth dimension and, as such, cannot effectively address the desire to have a single stock threshold span the many variations in wall- and frame-depth. Accordingly, many thresholds do not meet certain fire codes, some of which may require a true fire separation under the door and do not allow carpet-to-carpet detailing.

A typical opening where such problems arise may be, for example, a connecting room double-door setup (e.g. in a hotel), where it is desirable to span the entire frame depth. This arrangement is depicted in FIG. 3. Briefly, two doors 20*a-b* are provided for closing the entry way formed by walls 24*a-b*. A threshold 22 is disposed between doors 20*a-b*. As noted above, it would be advantageous to use a stock threshold to span the entire wall- and/or frame-depth. The threshold 22 would be set under doors 20*a-b* and have notches 26*a-d* for accommodating one or more stops 28*a-b*.

Thus, it will be appreciated by those skilled in the art that there exists a need in the art for an improved door threshold(s).

One aspect of certain example embodiments relates to a door threshold structure comprising a main body formed from a male foot and a female foot.

Another aspect of certain example embodiments relates to a door threshold structure comprising a main body formed from two female feet connected via a center insert. Other components are also possible in certain instances.

Still another aspect of certain example embodiments relates to a door threshold structure comprising a main body formed from two feet butt-joined to a center insert.

Yet another aspect of certain example embodiments relates to a door threshold structure comprising a main body formed from one foot joined to a riser.

Accordingly, in certain example embodiments, a door threshold structure to be at least partially located underneath at least one door when the at least one door is in a closed position, in combination with a carpet is provided. A first foot and a second foot may be configured to be connected (directly or indirectly) to form a main body of the door threshold structure. The first foot may include a protrusion formed thereon for engaging with a recession in the second foot. On at least one side of said main body there may be provided upper and lower members extending from the main body in spaced apart relation from one another so that the upper and lower members may be at least partially substantially parallel to one another. The carpet may be located adjacent to the threshold. A gap between the spaced apart upper and lower members may be configured to receive an end of said carpet.

In certain other example embodiments, a door threshold structure to be at least partially located underneath at least one door when the at least one door is in a closed position, in combination with a carpet, is provided, wherein the door threshold structure may comprise a first foot and a second foot configured to be connected via a center insert to form a main body of the door threshold structure. On at least one side of said main body there may be provided upper and lower members extending from the main body in spaced apart relation from one another so that the upper and lower members are at least partially substantially parallel to one another. The carpet may be located adjacent to the threshold. A gap between the spaced apart upper and lower members may be configured to receive an end of said carpet.

According to certain other example embodiments, a a door threshold structure to be at least partially located underneath at least one door when the at least one door is in a closed position, in combination with a carpet, is provided, and the door threshold structure may comprise a foot configured to be connected to a riser to form a main body of the door threshold structure. On one side of said main body there may be provided upper and lower members extending from the main body in spaced apart relation from one another so that the upper and lower members are at least partially substantially parallel to one another. The carpet may be located adjacent to the threshold. A gap between the spaced apart upper and lower members may be configured to receive an end of said carpet.

The upper member may be flexible and an end thereof may be biased downwardly toward an end of the bottom member in order to grip carpet located between the upper and lower members.

BRIEF DESCRIPTION OF THE DRAWINGS

These and other features and advantages will be better and more completely understood by reference to the following detailed description of exemplary illustrative embodiments in conjunction with the drawings, of which:

FIG. 6*a* is an illustrative center bridge insert 36, which may be used in conjunction with thresholds according to FIG. 5*a;*

FIG. 6*b* shows multiple illustrative interlocking center bridge inserts 36, which may be used to further vary the depth of the threshold, in accordance with an example embodiment;

FIG. 7 is an adjustable threshold for use with an optional riser, in accordance with an example embodiment; and, FIG. 8 is yet another adjustable threshold, in accordance with an example embodiment.

DETAILED DESCRIPTION OF EXAMPLE EMBODIMENTS OF THE INVENTION

Figure 3:
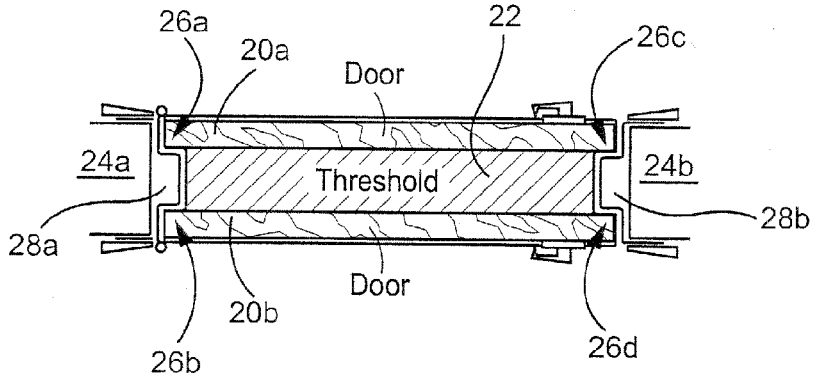
FIG. 3 is a top-view of a connecting room double-door setup.
Figure 4A:
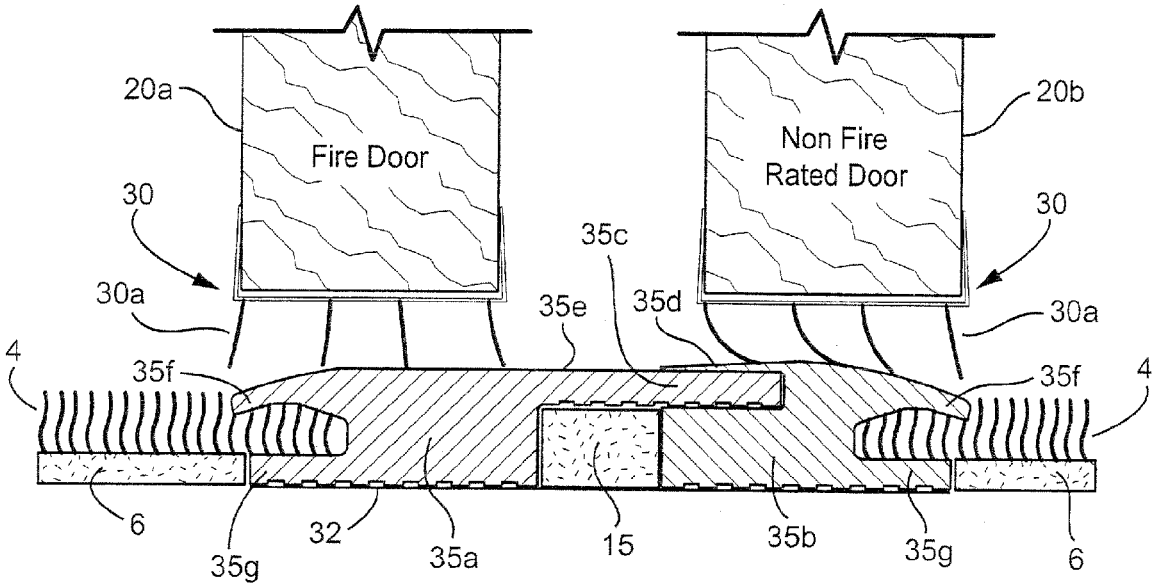
FIG. 4*a* is a perspective view of an adjustable threshold having a male-female connector, in accordance with an example embodiment.

Referring now more particularly to the drawings in which like reference numerals indicate like parts throughout the several views, FIG. 4*a* is a perspective view of an adjustable threshold having a male-female connector, in accordance with an example embodiment. As shown in FIG. 4*a*, the adjustable threshold is positioned under two doors 20*a-b* which may be, for example, a fire door and a non-fire rated door, respectively. Of course, it will be appreciated that either, both, or neither door need be a fire door. Top portion 35*e* of the adjustable threshold is located between doors 20*a-b*, and corresponds to the viewable portion of threshold 22 shown in FIG. 3.

Figure 1:
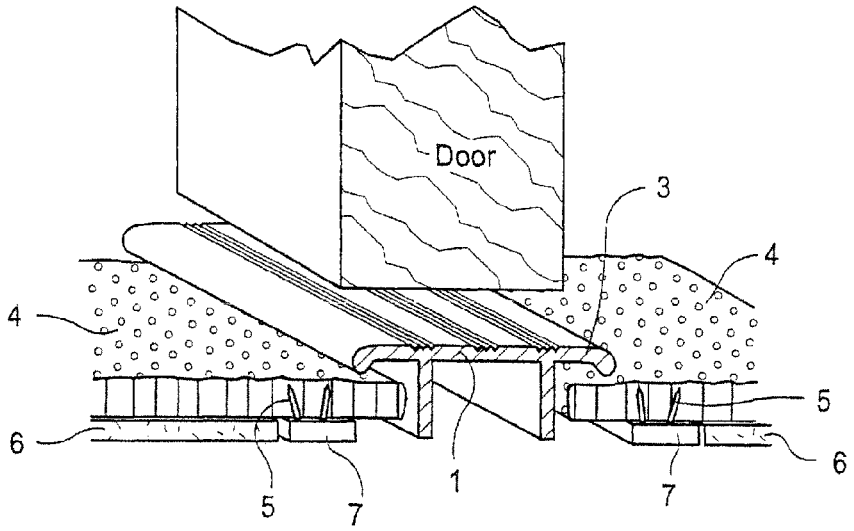
Fig. 1 (Prior Art)
FIG. 1 is a perspective view of a conventional door threshold structure.
Figure 2:
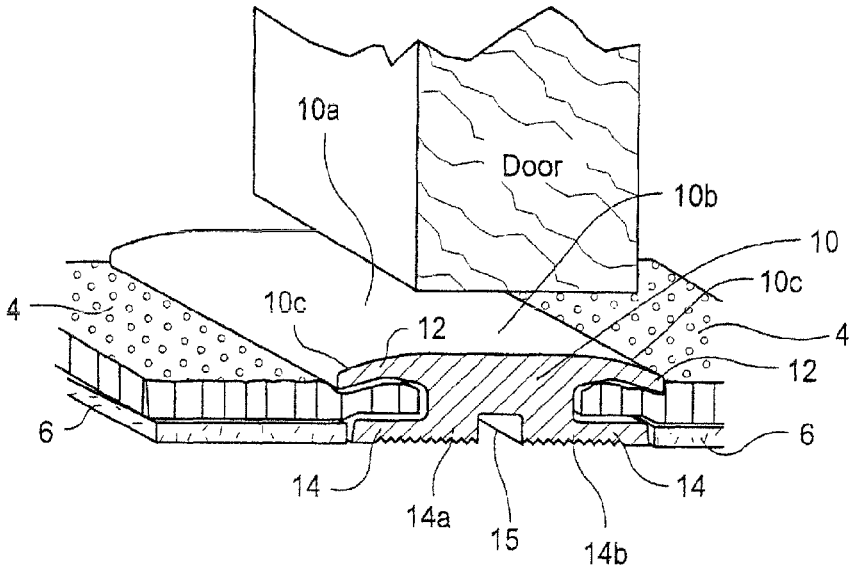
Fig. 2 (Prior Art)
FIG. 2 is a perspective view of a door threshold that reduces and/or eliminates the need for carpet tacks (note that tacks are still possible in certain example embodiments of this invention)

The heights of doors 20*a-b* optionally may be adjustable, for example, via adjustment mechanisms 30. Also, brushes (or sweep) 30*a* optionally may be located at the bottom of doors 20*a-b* and project downwards towards the adjustable threshold, for example, to at least partially seal (e.g. provide insulation, protection, separation, or the like between) adjacent areas. Like the threshold of FIG. 2, the adjustable threshold of FIG. 4*a* may include upper and lower members, 35*f-g*, respectively, which sandwich an end of carpet 4 therebetween. Carpet pad 6 may stop short of the lower member 35*g* so that only the carpet 4 is sandwiched between the upper and lower members 35*f-g* in certain example embodiments (although this need not be the case in all example embodiments). In certain example embodiments, at least parts of the upper and lower members 35*f-g* are substantially parallel (i.e., parallel plus/minus about 20 degrees) to one another.

In certain embodiments, upper and/or lower member(s) 35*f-g* grip or otherwise maintain the carpet 4 that is located therebetween. Thus, the need for carpet tacks proximate to the threshold is reduced and/or eliminated because the adjustable threshold itself maintains the end of the carpet in position and reduces the ease with which it is pulled out from between members 35*f-g*. While tacks are not needed in such areas in certain example instances, it is possible that tacks may be provided in other example embodiments of this invention. Upper member 35*f* may be flexible in certain embodiments, so as to provide a downward-directed biasing force against the carpet 4 to help maintain the end of the carpet between members 35*f-g*. The threshold further allows for a variety of different carpet and/or pad thicknesses, and can maintain a slight rise above the carpet for a door sweep to seal against and yet not rub or significantly rub on the carpet when closing.

Carpeting 4 typically is glued down or stretched and held by carpet tack strips along the walls. At the door opening, the carpet cannot be glued to a pad typically. The carpet tuck feature of the adjustable threshold effectively grips the carpet and reduces the ease with which it may be pulled away from the threshold. The carpet will have been stretched and held at either side of the door opening.

As shown in FIG. 4*a*, the adjustable threshold may be divided into two separate and distinct feet 35*a-b* that are separated from one another by gap or cavity 15. Feet 35*a-b* may be attached to the floor (or other support located over the floor) via an adhesive (accommodated by notches 32), screws, or the like. Feet 35*a-b* also may be counter-sunk into the floor. As shown in FIG. 4*a*, foot 35*a* has protrusion 35*c* for engaging with a corresponding recession formed in foot 35*b*. Optionally, a flange 35*d* is formed over a recession into which protrusion 35*c* may be inserted. Flange 35*d* is optional, though it may help smooth the joint between the foot and the protrusion. Thus, feet 35*a-b* may form a threshold via a male-female connection (e.g. a connection between foot 35*a* having a male protrusion, and foot 35*b* having a female recession). Foot 35*a* optionally may be formed to have a piece corresponding to the size, shape, and/or location of flange 35*d* (e.g. for aesthetic purposes). Protrusion 35*d* may slide into the recession of foot 35*b*. Alternatively, certain example embodiments may not have flange 35*d* located on foot 35*b*, and protrusion 35*c* may simply rest on the recession (which may be thought of as a notch) formed within foot 35*b*. Protrusion 35*d* may be connected to foot 35*b* using, for example, one or more of an adhesive, screws, etc. Some or all of protrusion 35*c* may be shortened (e.g. cut) to customize the depth of the assembled threshold. It has been determined that a protrusion of approximately 10" covers most implementations, though the invention is not so limited. Additionally, or in the alternative, several stock male feet 35*a* having varying lengths for protrusion 35*c* may be provided, and a close (or closest) foot may be chosen in a particular example.

Figure 4B:
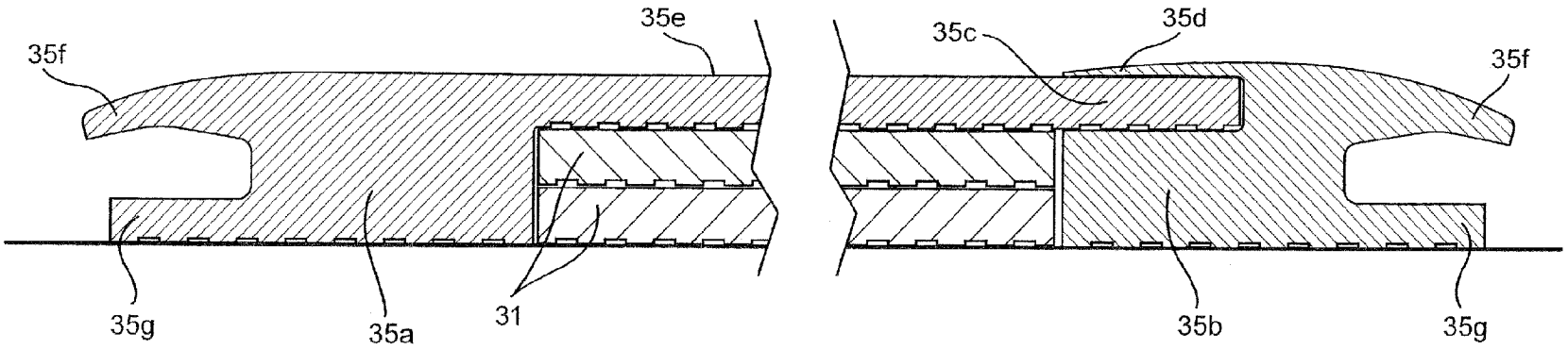
FIG. 4*b* shows an adjustable threshold similar to the configuration described with reference to FIG. 4*a*, except the gap of FIG. 4*a* is substantially filled in by one or more layers, in accordance with an example embodiment.

FIG. 4*b* shows an adjustable threshold similar to the configuration described with reference to FIG. 4*a*, except gap 15 of FIG. 4*a* is substantially filled in by one or more layers 31, in accordance with an example embodiment. The one or more layers 31 for filling in gap 15 of FIG. 4*a* may be made of the same material as the threshold, or any other suitable material. Also, the one or more layers 31 may be provided to supply additional support under protrusion 35*c* (e.g. at the substantially flat portion 35*e* located between doors 20*a-b*), which may be advantageous in certain embodiments where the depth of the assembled threshold is large.

Figure 4C:
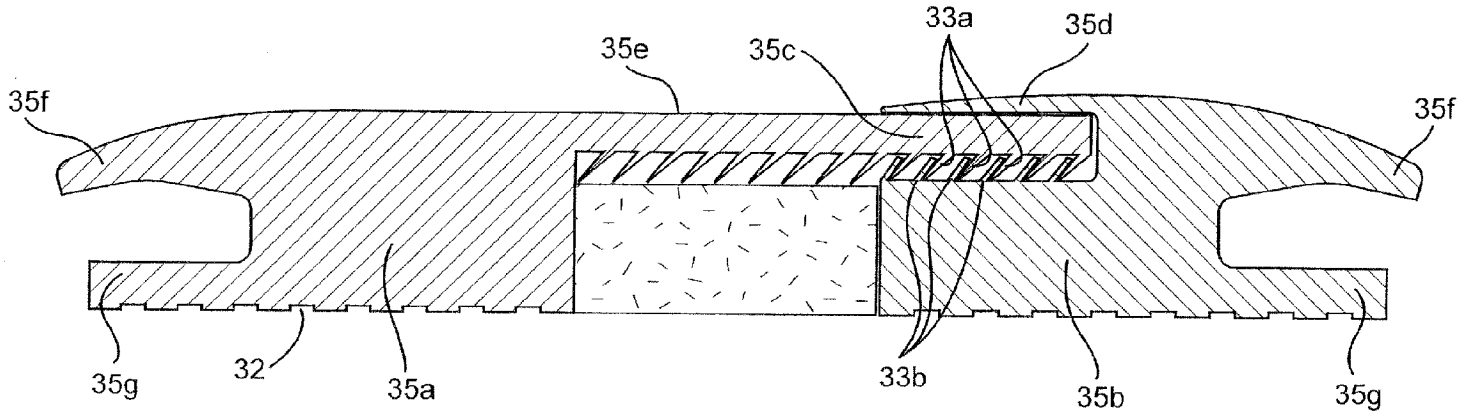
FIG. 4*c* is an adjustable threshold similar to the configuration described with reference to FIG. 4*a*, except the protrusion is shown as having a series of barbs for engaging with interlocking barbs disposed on the female foot, in accordance with an example embodiment.

FIG. 4*c* is an adjustable threshold similar to the configuration described with reference to FIG. 4*a*, except protrusion 35*c* is shown as having a series of barbs 33*a* for engaging with interlocking barbs 33*b* disposed on female foot 35*b*, in accordance with an example embodiment. Barbs 33*a* optionally may be angled towards male foot 35*a*, and barbs 33*b* optionally may be angled towards female foot 35*b* at substantially the same angle, thus forming an interlocking mechanism. In certain example embodiments, the interlocking barbs 33*a-b* may establish a substantially permanent connection, although the present invention is not so limited. Additionally, rather than disposing barbs, a ribbed surface (or corresponding ribbed surfaces) may be disposed on female foot 35*b* (and/or on protrusion 35*c*) for establishing a similar connection between feet 35*a-b*. Barbs 33*a-b* may be flexible in at least one direction, for example, to allow the feet 35*a-b* to be slid together depth-wise. Alternatively, barbs 33*a-b* may be rigid, potentially requiring the feet 35*a-b* to be slid together length-wise. It will be appreciated that interlocking barbs 33*a-b* and/or ribbed surfaces may be used in place of, or in addition to, other attachment mechanisms (e.g. an adhesive, screws, etc.). In certain example embodiments, protrusion 35*c* and/or female foot 35*b* may be machined to have interlocking barbs 33*a-b*, whereas interlocking barbs 33*a-b* may be affixed to protrusion 35*c* and/or female foot 35*b* after the main pieces are formed in certain other example embodiments.

Figure 5A:
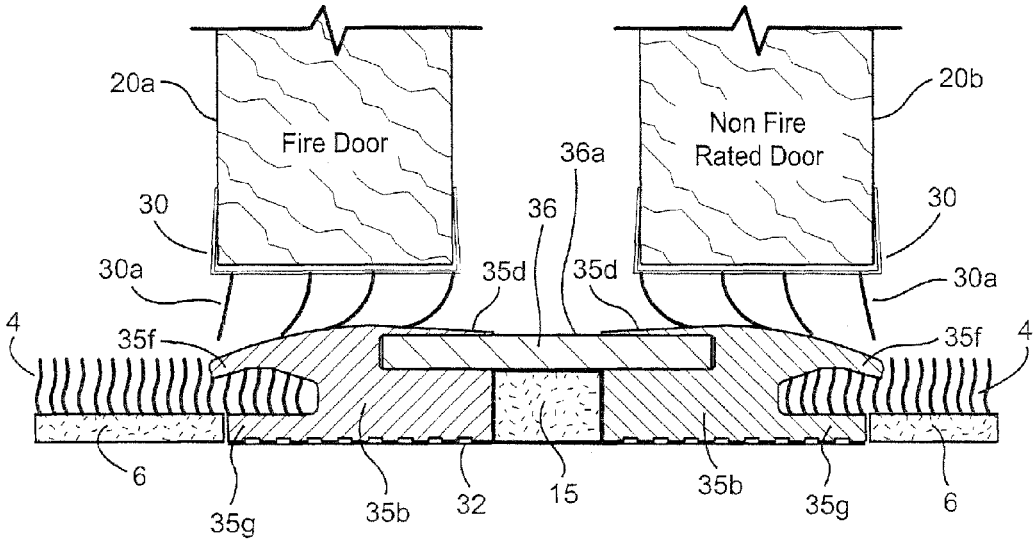
FIG. 5*a* is a perspective view of an adjustable threshold having a female-female connector for accommodating a center bridge insert, in accordance with an example embodiment.

FIG. 5*a* is a perspective view of an adjustable threshold having a female-female connector for accommodating a center bridge insert, in accordance with an example embodiment. The example embodiments described with reference to FIG. 5*a* are similar to those described with reference to FIG. 4*a*. In FIG. 5*a*, however, two female feet 35*b* are provided, each having recessions. A center bridge insert 36 may effectively join female feet 35*b*. As in FIG. 4*a*, flange 35*d* on each female foot 35*b* may help to form the recessions in each female foot 35*b*. The area between the two flanges 35*d* is a flat top portion 36*a* of center bridge insert 36. As above, it will be appreciated that flanges 35*d* are optional, and that center bridge insert 36 may simply rest on recessed (e.g. notched-out) portions of each female foot 35*b*. Also, as above, the center bridge insert 36 may be connected to each female foot 35*b* by using, for example, one or more of an adhesive, screws, etc., and it covers gap 15.

Figure 5B:
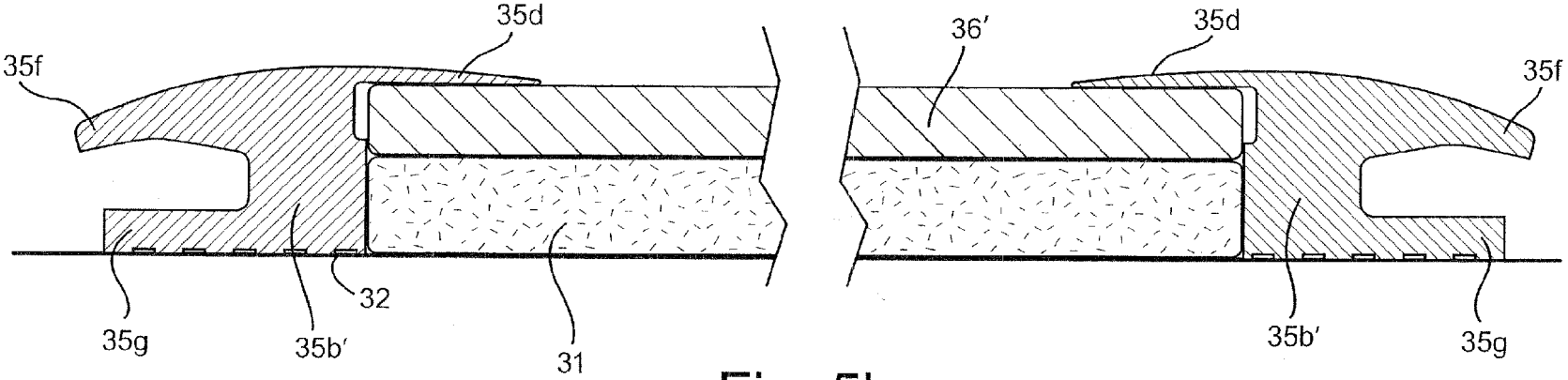
FIGS. 5*b-e* are perspective views of adjustable thresholds having female-female connectors for accommodating one or more center layers, in accordance with an example embodiment.
Figure 5C:
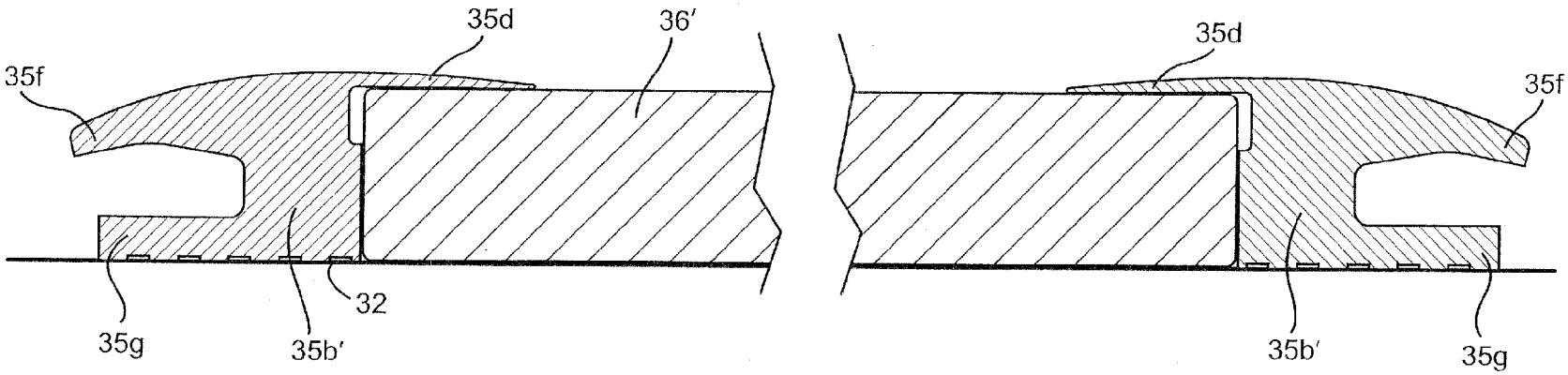

FIGS. 5*b-e* are perspective views of adjustable thresholds having female-female connectors for accommodating one or more center layers, in accordance with an example embodiment. In FIGS. 5*b-c*, a cavity for receiving a center bridge insert need not be formed in each female foot 35*b*'. For example, in FIG. 5*b*, a first layer 31 may support a second layer 36'. Second layer 36' may be, for example, marble, granite, wood, or any other type of decorative or non-decorative material. Flanges 35*d* may extend at least partially over the second layer 36'. Second layer 36' may simply lie on top of first layer 31, and/or they may be attached (e.g. via an adhesive, screws, etc.) to each other and/or to each foot 35*b*'.

Figure 5D:
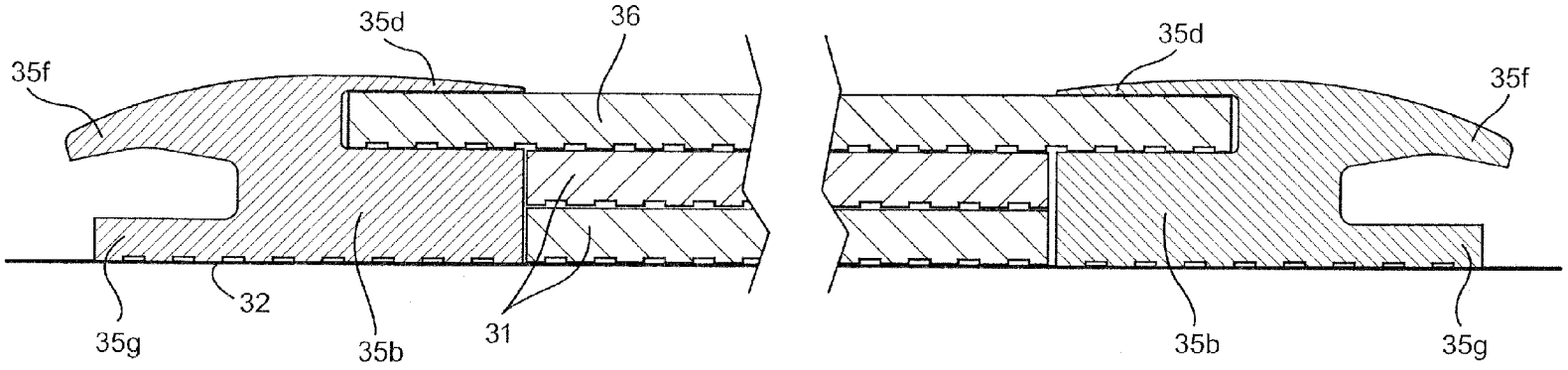
Figure 5E:
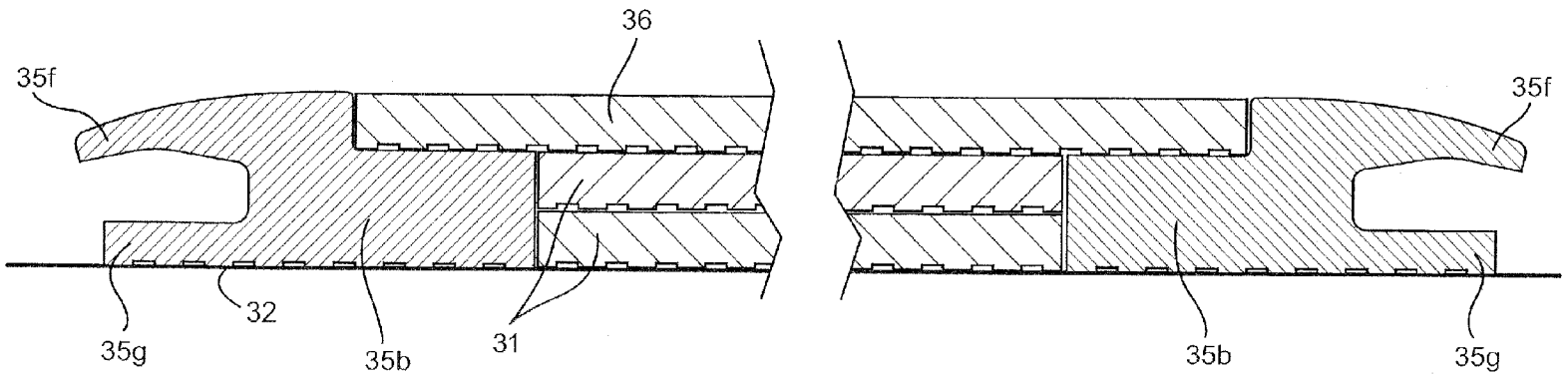

It will be appreciated that first layer 31 is optional, as shown by FIG. 5*c*, which simply has a large second layer 36' in its place. Similarly, it will be appreciated that multiple first layers 31 may be used in connection with certain example embodiments. This arrangement is shown in FIGS. 5*d-e*. FIG. 5*d* shows an embodiment with flanges 35*d*, while such flanges are not present in the FIG. 5*e* embodiment.

The embodiments described with reference to FIGS. 5*b-c* may be suitable for carpet-to-hardwood connections. In particular, by cutting back the on the base of a female foot 35*b*', the flooring may slide under the overhang, and the carpet may be tucked into the encapsulating female foot 35*b*'. Thus, an elevated transition may be created, keeping both materials on both sides of the adjustable thresholds substantially level.

FIG. 6*a* is an illustrative center bridge insert 36, which may be used in conjunction with thresholds according to FIG. 5*a*, and FIG. 6*b* shows multiple illustrative interlocking center bridge inserts 36, which may be used to further vary the depth of the threshold, in accordance with an example embodiment. Center bridge insert 36 may be formed from any suitable material, such as, for example, a fire-rated PVC, the same material as foot 35*b*, wood, etc., and it may be, for example, about 0.25" thick. Optionally, center bridge insert 36 may be extruded in color. Also, center bridge insert 36 may include teeth 39 disposed on the surface facing away from door(s). These teeth may engage with one or more layers 31 (not shown) to provide a mechanical connection therebetween, and/or help accommodate an adhesive disposed between layers.

A center bridge insert 36 may have opposing end connectors 38*a-b* such that an end connector 38*a* of a first center bridge insert is configured to engage with an end connector 38*b* of a second center bridge insert 36. Thus, the depth of the threshold may be varied by including one or more center bridge inserts 36. Also, opposing end connectors 38*a-b* may be further held together using an adhesive, screws, or the like, for example, to reduce bowing, add structural support, etc. Alternatively or in addition, a center bridge insert 36 may be cut to vary the depth of the threshold (similar to the way in which protrusion 35*c* of FIG. 4*a* may be cut)—e.g. a single center bridge insert 36 may be provided and optionally cut to an appropriate size, or multiple center bridge inserts 36 may be provided and one or more optionally may be cut to an appropriate size. It will be appreciated that the present invention is not limited to the end connectors shown in FIGS. 6*a-b*. Also, rather than; or in addition to, providing end connectors, multiple center bridge inserts 36 may be welded together to form a connection therebetween.

FIG. 7 is an adjustable threshold for use with an optional riser, in accordance with an example embodiment. Flange 35*d* optionally extends from adjustable threshold 40, forming a recession thereunder. Riser 42 may be disposed against this recession. As shown in FIG. 7, riser 42 is disposed substantially against threshold 40, although the invention is not so limited. For example, riser 42 may have a protruding member (not shown) for engaging with a recession formed within threshold 40 (e.g. similar to female foot 35*b* of FIG. 5*a*). Additionally, threshold 40 and riser 42 may be more securely connected using, for example, an adhesive, screws, etc. Riser 42 may vary in dimensions such as, for example, height, slope, etc., depending on the particular needs and/or confines of the space, handicapped accessibility codes, etc. Riser 42 may be formed from any suitable material, such as, for example, wood, metal, plastic, ceramics, tiles, stone (marble, granite, etc.), etc.

In an example embodiment not shown, a smaller riser 42 may be provided, and tile, carpet, etc. may be disposed on top of it. One example riser 42 that is believed to be compliant with relevant disability laws has a length of about 12", a height of about 0.25", and thus a rise of about 1.19 degrees; although, the present invention is so not limited to this arrangement.

Figure 8:
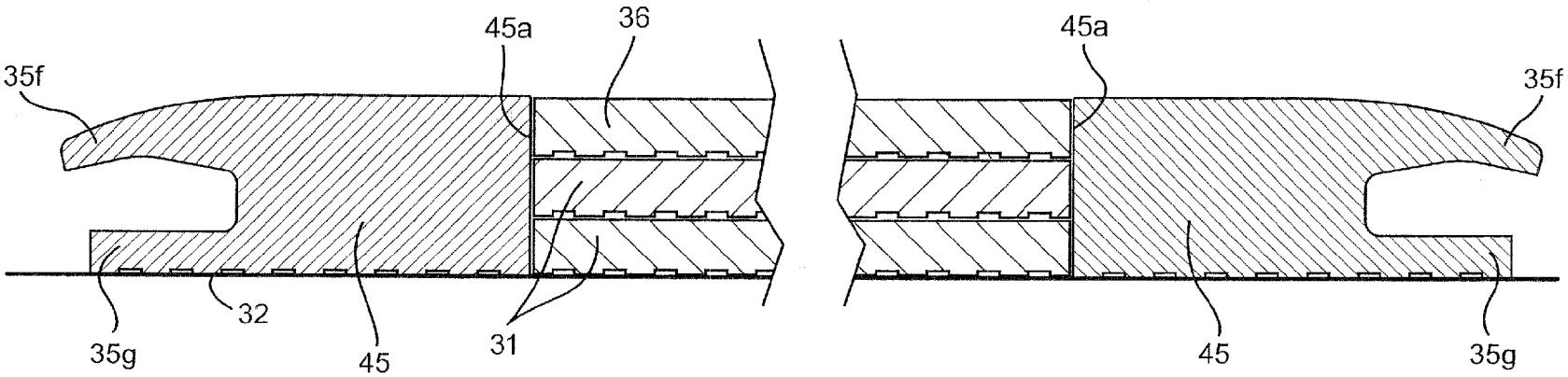

FIG. 8 is yet another adjustable threshold, in accordance with an example embodiment. Each foot 45 has a substantially flat inner surface 45*a*. Within opposing inner surfaces 45*a*, one or more first layers 31 and one or more second layers 36 may be provided. First layer(s) 31 and/or second layer(s) 36 may be cut to an appropriate size to vary the depth of the adjustable threshold. Alternatively, or in addition, a number of differently sized stock first layer(s) 31 and/or second layer(s) 36 may be provided to vary the depth of the adjustable threshold.

The example embodiments described herein may be further customized. For example, standard lengths may be provided and/or cut to a desired length. Optional risers may be disposed so as to increase the height from the floor to the top of the threshold, for example, to accommodate tile, hardwood, or the like; to receive a sub-floor leveler (e.g. made by flooring manufacturers to transition for ADA purposes); etc. The example embodiments described herein also may be used for other purposes. For example, adjustable thresholds may be used in cases where abutting carpets stop short of each other (e.g. where a hallway carpet stops short of a room's carpeting).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A door threshold structure to be at least partially located underneath a door when the door is in a closed position, the door threshold structure comprising:

a foot configured to be connected to a riser, the foot forming a main body of the door threshold structure, the foot to be located under the door when the door is in the closed position;

wherein, viewing the foot in cross section in a direction in which a closed door is to extend, the foot is asymmetric so that a first side of said main body includes upper and lower members extending from the main body in spaced apart relation from one another so that the upper and lower members are substantially parallel to one another, and a second side of the main body includes an upper member extending therefrom so as to be substantially parallel to the lower member extending from said first side, and wherein the second side of the main body, but not the first side, is adapted to be located adjacent the riser and has no lower member extending therefrom;

wherein a distal end portion of the upper member on the second side of the main body is substantially thinner in cross section than is a distal end portion of the upper member on the first side of the main body, and wherein a cutout is formed in a vertical wall of the main body where the upper member on the second side extends away from the main body, said cutout being defined between the upper member on the second side of the main body and the vertical wall of the main body, the vertical wall extending upward from the ground under the door to the cutout;

wherein carpet is to be located adjacent to the threshold; and wherein a gap between the spaced apart upper and lower members of the first side of the foot is configured to receive an end of the carpet.

* * * * *